US005095777A

United States Patent [19]

Osmar et al.

[11] Patent Number: 5,095,777

[45] Date of Patent: Mar. 17, 1992

[54] CAN OPENING DEVICE

[76] Inventors: Per E. Osmar; Frances L. Osmar, both of Box 38, Clam Gulch, Ak. 99568

[21] Appl. No.: 737,005

[22] Filed: Jul. 29, 1991

[51] Int. Cl.[5] ..... B67B 7/44

[52] U.S. Cl. ..... 81/3.09; 81/3.55

[58] Field of Search ..... 81/3.07, 3.09, 3.4, 81/3.55

[56] References Cited

U.S. PATENT DOCUMENTS

| | | | |
|---|---|---|---|
| 1,368,038 | 2/1921 | Larsen . | |
| 1,461,151 | 7/1923 | Keeler | 81/3.07 |
| 4,133,228 | 1/1979 | DePooter | 81/3.09 |
| 4,241,626 | 12/1980 | Hall | 81/3.55 |
| 4,253,352 | 3/1981 | O'Neal | 81/3.46 R |
| 4,257,287 | 3/1981 | Dawson | 81/3.34 |
| 4,309,921 | 1/1982 | Miller | 81/3.46 R |
| 4,416,171 | 11/1983 | Chmela et al. | 81/3.46 R |
| 4,563,919 | 1/1986 | Sellars | 81/3.55 |

FOREIGN PATENT DOCUMENTS

| | | | |
|---|---|---|---|
| 813653 | 9/1951 | Fed. Rep. of Germany . | |
| 2496626 | 6/1982 | France | 81/3.4 |

*Primary Examiner*—Roscoe V. Parker

*Attorney, Agent, or Firm*—Christensen, O'Connor, Johnson & Kindness

[57] ABSTRACT

A one-piece elongated body has a widened handle end portion at one end and a sharpened nose end portion at the other end. A slot extending lengthwise of the body opens generally centrally of the nose end portion. A can of the type having an opening ring attached to a lid separable from the base of the can by manipulation of the opening ring can be opened easily by use of the device by either: (1) inserting the nose of the device through the aperture of the opening ring until the ring engages in a notch adjacent to the nose portion, whereupon the device can be pulled for separating the lid from the can; or (2) sliding the device toward the opening ring such that the ring is fitted in the slot, wedging the ring upward by upward-swinging of the device, followed by turning the device such that the ring is fitted sideways in the slot and rotating the device in a screwing motion for peeling the lid from the can.

7 Claims, 2 Drawing Sheets

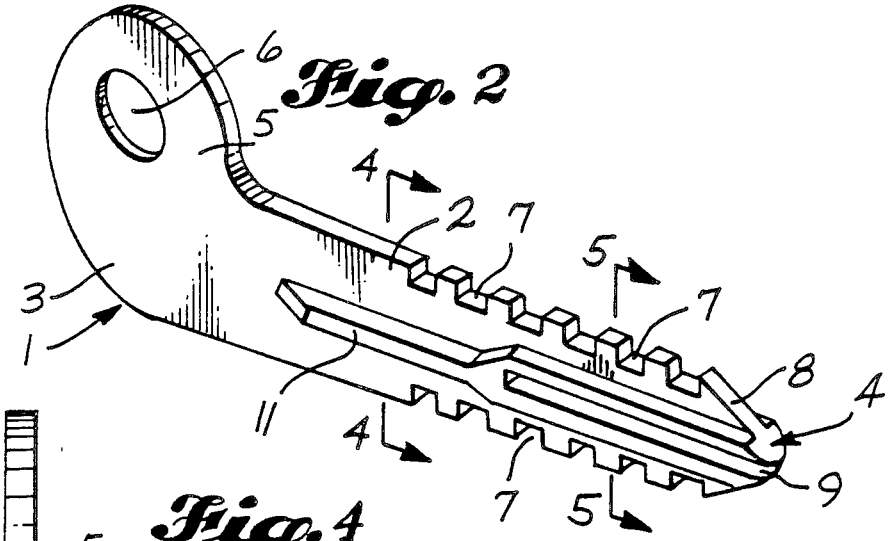
Fig. 2
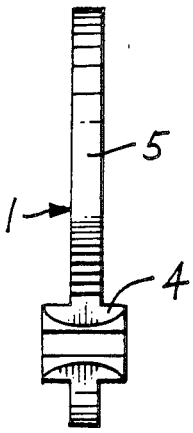
Fig. 4
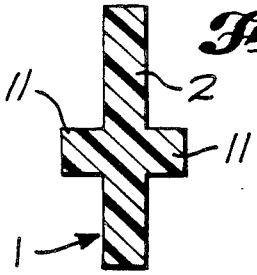
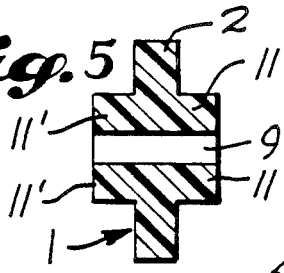
Fig. 5
Fig. 3
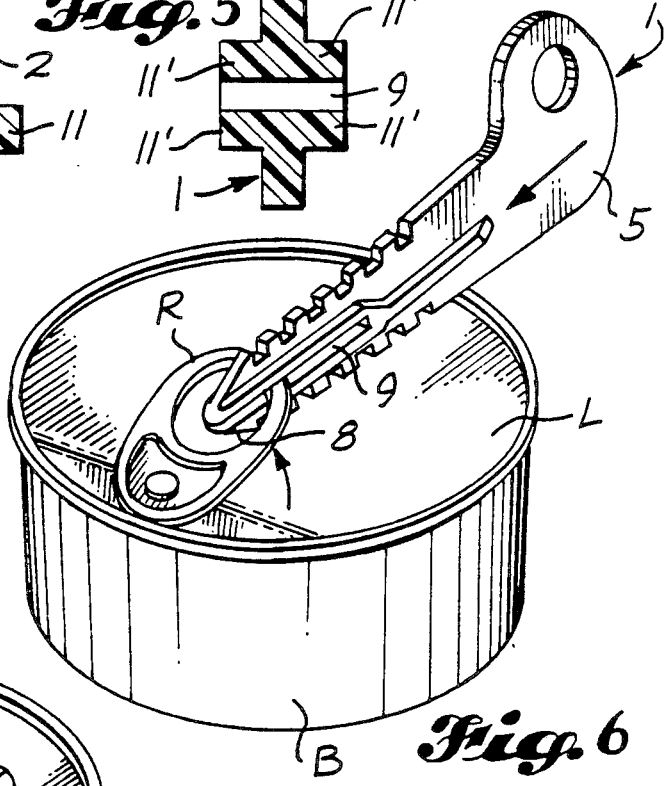
Fig. 6
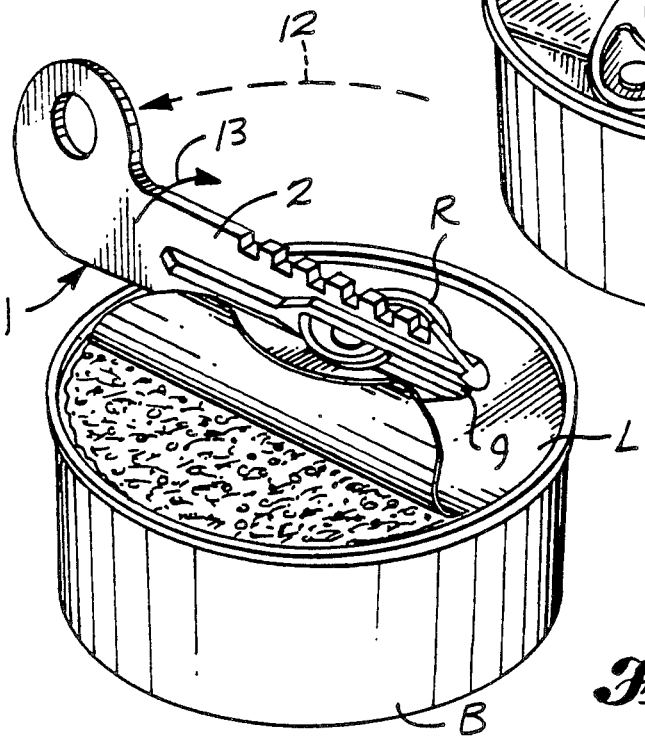
Fig. 7

CAN OPENING DEVICE

BACKGROUND OF THE INVENTION

1. Field of the Invention

The present invention relates to a device for opening a can of the type having a lid intended to be separable from the base of the can by manipulation of an opening ring attached to the lid.

2. Prior Art

Pop-top beverage containers have lid portions with a small round or oval area that can be opened to dispense the liquid contents of the container. Although intended to be opened manually, various devices have been proposed to assist in opening such pop-top containers including the devices shown in the following patents:

U.S. Pat. No. 4,253,352, issued Mar. 3, 1981 (O'Neal);
U.S. Pat. No. 4,257,287, issued Mar. 24, 1981 (Dawson);
U.S. Pat. No. 4,309,921, issued Jan. 12, 1982 (Miller);
U.S. Pat. No. 4,416,171, issued Nov. 22, 1983 (Chmela et al.);
U.S. Pat. No. 4,563,919, issued Jan. 14, 1986 (Sellars).

Earlier can designs had lids intended to be removable by special tools such as the devices shown in the following patents:

U.S. Pat. No. 1,368,038, issued Feb. 8, 1921 (Larsen);
German patentschrift No. 813,653, dated July 8, 1949 (Kracht).

There is another container or can design in which a ring is riveted to the lid of the can. The ring is intended to be swung upward and then pulled manually so as to tear the lid from the base of the can and expose the contents. Opening such cans manually can be difficult for those with limited dexterity and can be tiresome and painful if large numbers of cans must be opened in a short period. Nevertheless, there are no known tools for assisting in opening such cans.

SUMMARY OF THE INVENTION

The present invention provides a device for opening a can of the type having a lid with attached opening ring designed to be manipulated manually for tearing the entire lid from the base of the can. The device makes it easier to open such cans, particularly by those having limited dexterity.

In the preferred embodiment, the can opening device in accordance with the present invention includes an elongated body with a transversely extending handle portion at one end and a sharpened nose at the other end. The nose can be slid under the opening ring of the can to bend the ring upward. Then the nose of the opening device can be inserted through the aperture of the ring so that a peripheral portion of the ring engages in a notch in the body of the opening device. The device then can be pulled rearward to tear the lid from the can without having to grasp the thin opening ring itself.

The nose portion of the opening device in accordance with the present invention preferably has a central slot such that, in an alternative manner of use, the device is moved lengthwise toward the opening ring of the can until the ring is received in the slot. The device can be swung upward like a lever to raise the ring. Next the device is rotated 90 degrees to a transversely extending position with the ring still received in the slot. The lid then can be peeled from the base of the can by a screwing motion of the opening device.

BRIEF DESCRIPTION OF THE DRAWINGS

FIG. 2 is a top perspective of a can opening device in accordance with the present invention; FIG. 3 is a front end elevation of such device; FIG. 4 is a section taken along line 4—4 of FIG. 2; and FIG. 5 is a section taken along 5—5 of FIG. 2.

FIG. 6 and FIG. 7 are corresponding top perspectives of a can and a can opening device in accordance with the present invention with parts in different positions to illustrate one procedure of opening the can by use of such device.

DETAILED DESCRIPTION

Figure 1:
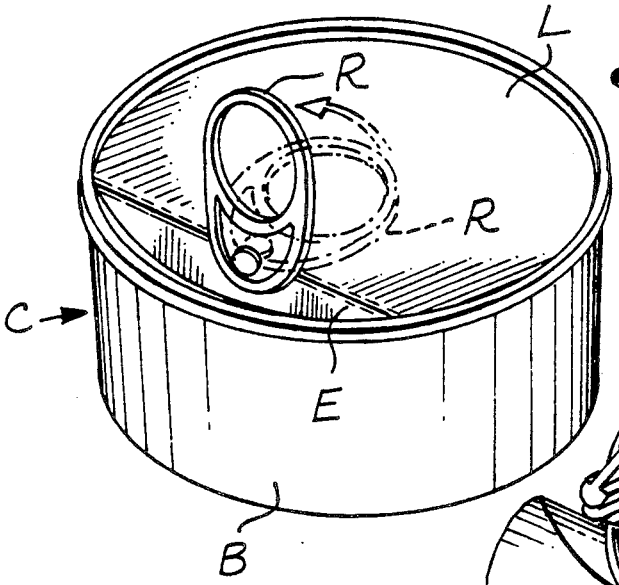
Fig. 1 PRIOR ART
FIG. 1 is a somewhat diagrammatic top perspective of a known container of the type with which the present invention is concerned.

FIG. 1 illustrates the general type of can C that can be opened quickly, easily and painlessly by the can opening device in accordance with the present invention. Can C includes the open-topped base B and lid L which normally closes the top of the base. An oval opening ring R has one end portion riveted to lid L and normally lies almost flat against the lid as indicated in broken lines in FIG. 1. In use, ring R is moved manually to the solid line position shown in FIG. 1 in which the ring extends substantially perpendicular to most of the lid L. The upward-swinging movement of the ring wedges an edge portion E of the lid downward so as to free it from the base B. The ring is then pulled upward while the base B is held securely so as to tear the lid from the can and reveal the contents. The procedure of swinging the opening ring R upward and thereafter exerting a strong steady pull while holding the base stationary can be difficult and tiring.

With reference to FIGS. 2 through 5, the opening device 1 in accordance with the present invention includes an elongated body 2 having a handle end portion 3 and nose end portion 4. The handle end portion 3 preferably includes a transversely extending projection 5 with a fingerhole 6. The body portion 2 of the device is substantially longer than it is wide and substantially wider than it is thick. Such body tapers uniformly and gradually in width (the upright dimension as viewed in FIG. 2) from the handle end portion toward the nose portion. Square notches 7 are provided along the top and bottom edges of the body section 2, at least in the area adjacent to the nose portion 4.

The nose portion of the can opening device 1 has flat top and bottom beveled surfaces 8 forming a substantially sharpened tip at the leading end of the device. In the preferred embodiment, a long slot 9 extends longitudinally of the body 2 and opens centrally of the tip of the nose portion 4. The slot also opens laterally through the sides of the device. Integral ribs 11 extend oppositely from the body section 2 and nose portion 4, including ribs 11' that extend along the top and bottom of the slot 9 at both sides of the device as seen in FIG. 5 to strengthen and rigidify the lid.

The device in accordance with the present invention can be used at least two different ways to open a can of the type shown in FIG. 1. With reference to FIG. 6, the device can be grasped at its handle end portion 5 and placed such that the bottom beveled surface 8 substantially contiguously engages the top of the can lid L adjacent to the edge of the ring R opposite its point of connection to the lid. The device 1 then can be slid lengthwise toward the ring such that the ring is fitted in the slot 9. Slot 9 is inclined relative to the lid of the can and the ring R is automatically swung upward as the device is slid forward. When the ring is received full into the slot 9, the device can be swung upward farther such that the ring extends substantially perpendicular to the lid.

Next, as indicated by the broken line arrow 12 in FIG. 7, the device is swung 90 degrees so as to extend transversely to the length of the oval opening ring R but with the ring still received in the slot 9. From such position the device is rotated rearward about its longitudinal axis, as indicated by the solid line arrow 13, with the bottom of the body 2 engaged against the rim of the can. The result is that the lid L is peeled from the base B of the can. As shown in the drawings the opening device retains its shape during the opening procedure, i.e., the body of the device is substantially rigid.

Figure 9:
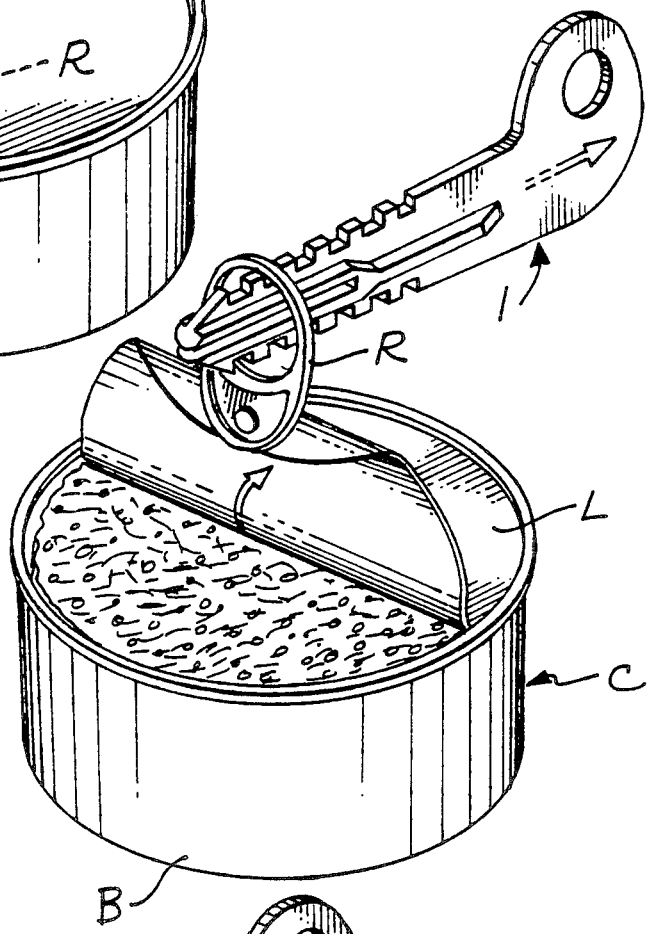
FIG. 8 and FIG. 9 are corresponding top perspectives of a can and a can opening device in accordance with the present invention with parts in different position to illustrate an alternative procedure for opening the can by use of such device.
Figure 8:
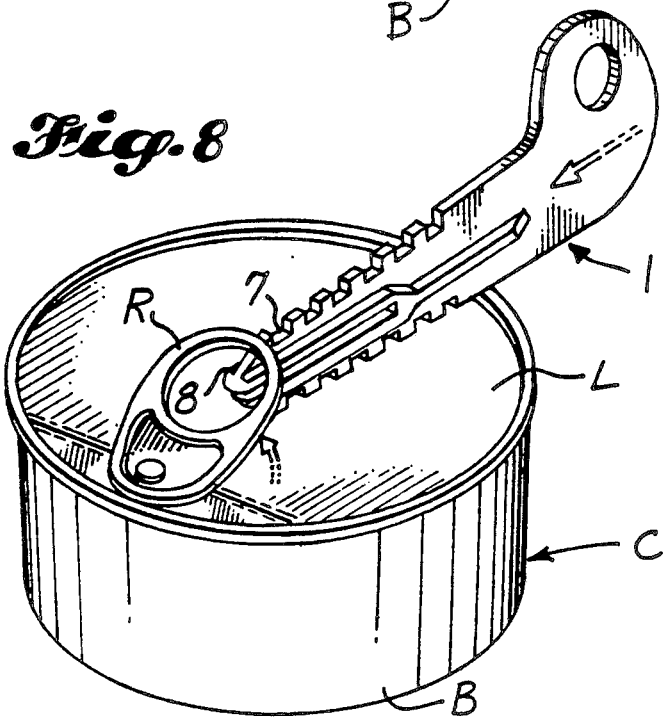

With reference to FIG. 8, in an alternative procedure for opening the can C by use of the device 1 in accordance with the present invention, the device can be tilted more sharply relative to the lid L as the device is first moved toward the opening ring R so that the top beveled surface 8 of the nose portion 4 fits under the opening ring R. Forward movement of the device is continued until the ring is pried upward whereupon the device is swung down and its nose passes through the aperture of the ring. In such position, the edge of the ring opposite its point of attachment to the lid will engage in one of the notches 7. With reference to FIG. 9, the device then can be pulled rearward to separate the lid L from the base B of the can.

In either procedure, the user need not grasp the thin opening ring and the lid is separated from the base much more easily than if it were necessary to manually pull on the ring.

We claim:

1. A device for opening a can of the type having an opening ring with a central aperture which ring is attached to a lid separable from the base of the can by manipulation of the opening ring, said device comprising an elongated body much longer than it is wide and much wider than it is thick and having a handle end portion and a nose end portion, said nose end portion of said body having a sharpened tip insertable through the aperture of the opening ring, said body having a notch adjacent to said tip for receiving a peripheral portion of the opening ring after insertion of said tip therethrough for exerting force on said ring by manipulation of said body, said body further having a slot extending longitudinally thereof and opening through said tip and through the opposite sides of said body for reception of the opening ring therein, and including integral strengthening ribs projecting from the opposite sides of said body.

2. The device defined in claim 1, in which the nose end portion includes a flat beveled surface extending from the sharpened tip toward the notch.

3. The device defined in claim 1, in which the strengthening ribs include ribs extending along opposite sides of the slot.

4. The device defined in claim 1, in which the handle end portion of the body includes a transversely extending projection having a finger hole.

5. A device for opening a can of the type having an opening ring attached to a lid separable from the base of the can by manipulation of the opening ring, said device comprising an elongated substantially rigid body having a handle end portion and a nose end portion, said nose end portion of said body having top and bottom beveled surfaces forming a sharpened tip, said body having a slot opening centrally of said tip between said top and bottom beveled surfaces and through the opposite sides of said body adjacent to said tip for reception of the opening ring therein, whereby said body can be manipulated to receive the opening ring in said slot for lifting said ring followed by twisting of said body to peel the lid from the base of the can.

6. The device defined in claim 5, in which the body includes at least one notch adjacent to the nose portion for engaging a section of the opening ring after passage of the nose end portion through the ring.

7. The device defined in claim 5, in which the handle end portion of the body includes a transversely extending projection having a finger hole.

* * * * *